US006779855B2

(12) United States Patent
Hoffman

(10) Patent No.: US 6,779,855 B2
(45) Date of Patent: Aug. 24, 2004

(54) INTERLOCK MECHANISM FOR LATERAL FILE CABINETS

(75) Inventor: Keith A. Hoffman, Hudsonville, MI (US)

(73) Assignee: Knape & Vogt Manufacturing Co., Grand Rapids, MI (US)

( * ) Notice: Subject to any disclaimer, the term of this patent is extended or adjusted under 35 U.S.C. 154(b) by 0 days.

(21) Appl. No.: 10/375,774

(22) Filed: Feb. 27, 2003

(65) Prior Publication Data

US 2004/0100166 A1 May 27, 2004

Related U.S. Application Data

(60) Provisional application No. 60/429,772, filed on Nov. 27, 2002.

(51) Int. Cl.[7] ..... E05C 7/06
(52) U.S. Cl. ..... 312/219; 312/221
(58) Field of Search ..... 312/215, 216, 312/217, 218, 219, 221

(56) References Cited

U.S. PATENT DOCUMENTS

| | | | | |
|---|---|---|---|---|
| 3,799,638 A | * | 3/1974 | Faiks | 312/216 |
| 3,941,441 A | | 3/1976 | Scheerhorn | |
| 4,239,309 A | | 12/1980 | De Fouw et al. | |
| 4,240,685 A | | 12/1980 | Terlecki | |
| 4,246,769 A | | 1/1981 | McLaughlin | |
| 4,355,851 A | | 10/1982 | Slusser | |
| 4,429,930 A | | 2/1984 | Blouin | |
| 4,637,667 A | | 1/1987 | Reid et al. | |
| 4,711,505 A | | 12/1987 | Lakso | |
| 4,732,434 A | | 3/1988 | Hartrum | |
| 4,737,039 A | | 4/1988 | Sekerich | |
| 4,820,002 A | | 4/1989 | Lechner | |
| 4,889,396 A | | 12/1989 | Mitchell et al. | |
| 4,955,672 A | | 9/1990 | Pham | |
| 4,957,334 A | | 9/1990 | Lakso | |
| 4,960,309 A | | 10/1990 | Scheerhorn | |
| 4,966,423 A | | 10/1990 | Higuera | |

(List continued on next page.)

FOREIGN PATENT DOCUMENTS

| | | | |
|---|---|---|---|
| DE | 19654852 | * | 6/1998 |
| JP | 9-234129 | * | 9/1997 |
| JP | 10-205191 | * | 8/1998 |

OTHER PUBLICATIONS

U.S. patent application US 2002/0093274 A1 issued to Jackson, Jul. 18, 2002.
U.S. patent application Publication US 2002/0014817 A1 issued to Lammens, Feb. 7, 2002.
5–page Knape & Vogt Interlok brochure describing an interlock system that pre–dates the filing of the present application.
1–page Knape & Vogt Interlock brochure (double–sided) describing an interlock system dated 1997.
1–page Knape & Vogt Interlok brochure (double–sided) describing an interlock system dated 1997.

*Primary Examiner*—Janet M. Wilkens
(74) *Attorney, Agent, or Firm*—Van Dyke, Gardner, Linn & Burkhart, LLP

(57) ABSTRACT

Interlocks for file cabinets and the like which generally prevent more than one drawer from being opened at a given time. The interlocks include a elongated, flexible member, such as a cable, which is changeable from a high slack condition to a low slack condition. In the low slack condition, the interlocks prevent their associated drawers that are closed from being opened. In the high slack condition, the interlocks allow their associated drawer to be opened. The interlocks may be used in conjunction with a lock that selectively changes the cable from a high slack condition to a low slack condition and vice versa. The interlocks may be constructed to exert a force on the cable that is independent of the pulling force exerted on a locked drawer.

21 Claims, 15 Drawing Sheets

U.S. PATENT DOCUMENTS

| | | | |
|---|---|---|---|
| 5,050,942 | A | 9/1991 | Frederick et al. |
| 5,056,876 | A | 10/1991 | Scheerhorn |
| 5,056,877 | A | 10/1991 | Westwinkel |
| 5,062,678 | A | 11/1991 | Westwinkel |
| 5,176,436 | A | 1/1993 | Mitchell |
| 5,184,887 | A | 2/1993 | O'Keefe et al. |
| 5,199,774 | A | 4/1993 | Hedinger et al. |
| 5,225,825 | A | 7/1993 | Warren |
| 5,303,994 | A | 4/1994 | Elsholz |
| 5,333,949 | A | 8/1994 | McGregor |
| 5,335,986 | A | 8/1994 | Hartrum et al. |
| 5,352,030 | A | 10/1994 | Derle |
| 5,389,919 | A | 2/1995 | Warren et al. |
| 5,427,445 | A | 6/1995 | Mitchell |
| 5,466,060 | A | 11/1995 | Hoffman |
| 5,472,272 | A | 12/1995 | Hoffman |
| 5,507,571 | A | 4/1996 | Hoffman |
| 5,533,798 | A | 7/1996 | Feldpausch et al. |
| 5,586,817 | A | 12/1996 | Hubbard et al. |
| 5,671,985 | A | 9/1997 | Grieser |
| 5,685,622 | A | 11/1997 | Laakso |
| 5,695,265 | A | 12/1997 | Hoffman |
| 5,709,442 | A | 1/1998 | Feldpausch et al. |
| 5,805,074 | A | 9/1998 | Warren et al. |
| 5,823,643 | A | 10/1998 | Feldpausch et al. |
| 5,829,859 | A | 11/1998 | Cram |
| 5,865,404 | A | 2/1999 | Hesley |
| 5,868,479 | A | 2/1999 | Hoffman |
| 5,931,548 | A | 8/1999 | Bischoff |
| 5,988,778 | A | 11/1999 | Lammens |
| 5,997,114 | A | 12/1999 | Bischoff |
| 6,033,047 | A | 3/2000 | Hoffman |
| 6,082,839 | A | 7/2000 | Chiku |
| 6,186,606 | B1 | 2/2001 | Krei |
| 6,238,024 | B1 | 5/2001 | Sawatzky |
| 6,296,332 | B1 | 10/2001 | Lammens |

* cited by examiner

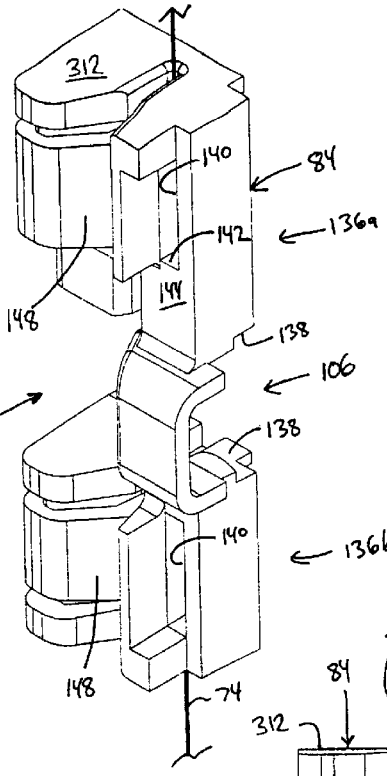
FIG. 21
FIG. 22
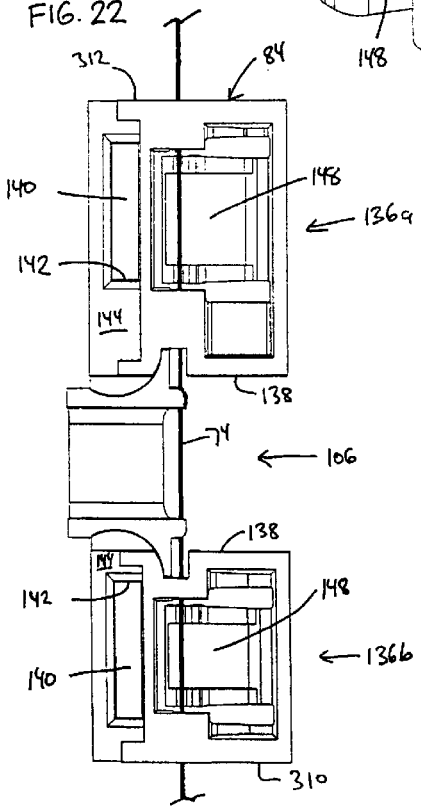
FIG. 23
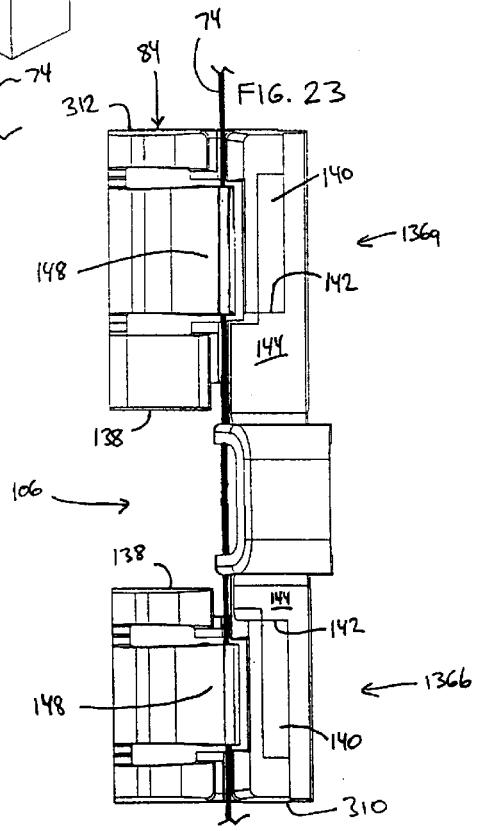

INTERLOCK MECHANISM FOR LATERAL FILE CABINETS

This application claims priority to commonly-assigned U.S. Provisional Patent Application Serial No. 60/429,772, filed Nov. 27, 2002, the disclosure of which is hereby incorporated herein in its entirety by reference.

BACKGROUND OF THE INVENTION

The present invention relates to filing cabinets, and more particularly to mechanisms adapted to prevent one or more of the drawers in the filing cabinet from being opened.

It has been known in the past to include interlock mechanisms on filing cabinets that prevent more than one drawer in the cabinet from being opened at a single time. These interlock mechanisms are generally provided as safety features that are intended to prevent the filing cabinet from accidentally falling over, a condition that may be more likely to occur when more than one drawer in the cabinet is open. By being able to open only a single drawer at a given time, the ability to change the weight distribution of the cabinet and its contents is reduced, thereby diminishing the likelihood that the cabinet will fall over.

In addition to such interlocks, past filing cabinets have also included locks that prevent any drawers from being opened when the lock is moved to a locking position. These locks are provided to address security issues, rather than safety issues. These locks override the interlocking system so that if the lock is activated, no drawers may be opened at all. If the lock is not activated, the interlock system functions to prevent more than one drawer from being opened at the same time. Oftentimes the system that locks all of the drawers and the interlock system that locks all but one of the drawers are at least partially combined. The combination of the locking system with the interlocking system can provide cost reductions by utilizing common parts.

Past locking and interlocking mechanisms, however, have suffered from a number of disadvantages. One disadvantage is the difficulty of changing the drawer configurations within a cabinet. Many filing cabinets are designed to allow different numbers of drawers to be housed within the cabinet. For example, in the cabinet depicted in FIG. 1, there are three drawers in the cabinet. For some cabinets, it would be possible to replace these three drawers with another number of drawers having the same total height as the three original drawers. This reconfirmation of the drawers is accomplished by removing the drawer slides on each side of the drawer and either repositioning the drawer slides at the newly desired heights, or installing new drawer slides at the new heights. Many drawer slides include bayonet features that allow the drawer slides to be easily removed and repositioned within the cabinet.

In the past, such reconfiguring of the drawers in a cabinet has been a difficult task because the interlocking and/or locking system for the drawers could not easily be adjusted to match the newly configured filing cabinet. For example, U.S. Pat. No. 6,238,024 issued to Sawatzky discloses an interlock system that utilizes a series of rigid rods that are vertically positioned between each drawer in the cabinet. The height of these rods must be chosen to match the vertical spacing between each of the drawers in the system. If the cabinet is to be reconfigured, then new rods will have to be installed that match the height of the new drawers being installed in the cabinet. Not only does this add additional cost to the process of reconfiguring the cabinet, it complicates the reconfiguring process by requiring new parts of precise dimensions to be ordered. Finding these precisely dimensioned parts may involve extensive searching and/or measuring, especially where the manufacturer of the rods is not the same entity that produced the new drawers being installed, or the manufacturer of the rods has ceased producing the parts, or has gone out of business.

Another difficulty with systems like that disclosed in the Sawatzky patent is the precise manufacturing that may be required to create these rigid rods. These interlock systems only work if the rods have heights that fall within a certain tolerance range. This tolerance range, however, decreases as more interlocks are installed in a given cabinet. In other words, the tolerance of the heights of these rods is additive. In order to function properly, a cabinet with ten drawers will therefore require smaller tolerances in the rods than a two drawer cabinet. In order to create rods that can be universally used on different cabinets, it is therefore necessary to manufacture the rods within the tight tolerances required by the cabinet having the greatest expected number of drawers. These tight tolerances tend to increase the cost of the manufacturing process.

Another difficulty with past interlock and lock systems for file cabinets has been the expense involved in creating a locking system that will withstand high forces exerted on the drawers. The Business and Institutional Furniture Manufacturer's Association (BIFMA) recommends that lock systems for file cabinets be able to withstand 50 pounds of pressure on a drawer. Thus, if a file cabinet does not exceed this standard, thieves can gain access to the contents of a lock drawer by pulling the drawer outwardly with more than fifty pounds of force. Many users of file cabinets, however, desire their locking system to be able to withstand much greater forces than this before failure. Increasing the durability of the locking system often adds undesired expense to the cost of building the system.

A number of prior art interlock systems have used cables or straps as part of the interlocking system. Such systems, however, have suffered from other disadvantages. For example, U.S. Pat. No. 5,199,774 issued to Hedinger et al. discloses an interlock and lock system that uses a cable. The slack in the cable is decreased when a drawer is opened. The amount of slack of the cable is carefully chosen during the installation of the drawer lock so that there is just enough in the system to allow only one drawer to be opened at a time. The interlock on whatever drawer is opened takes up this available slack in the cable, which prevents other drawers from being opened at the same time. A similar system is disclosed in U.S. Pat. No. 5,062,678 issued to Westwinkel. This system uses a strap instead of a cable. Both systems suffer from the fact that excessive amounts of force may be easily transferred to either the cable or the strap. In other words, the cable or the strap itself are what resist the pulling force that a person might exert on a closed drawer when either the lock is activated, or another drawer is opened. The tensile strength of the cable or strap therefore determines how much force must be exerted to overcome the interlock or lock. In fact, in the interlock of Westwinkel, the system appears to be constructed so that the pulling force exerted by a person on a locked drawer will be amplified before being applied to the strap. The strap must therefore have a greater tensile strength than the highest rated pulling force that the lock or interlock system can resist. Increasing the strength of the cables or straps typically tends to increase their cost, which is desirably avoided.

In light of the foregoing, the desirability of an interlock and lock system that overcomes these and other disadvantages can be seen.

SUMMARY OF THE INVENTION

Accordingly, the present invention provides an interlock and lock that reduces the aforementioned difficulties, as well as other difficulties. The interlock and lock of the present invention allow relatively low-tensile strength cables or flexible members to be used in systems which provide high resistance to theft and breakdown. The system of the present invention further allows changes to cabinet configurations to be easily implemented with little or no additional work required to integrate the new cabinet configuration into the interlock or lock system. The present invention provides a simple construction for locks and interlocks that can be easily manufactured without excessively restrictive tolerances, and which can be easily installed in cabinets.

According to one aspect of the present invention, an interlock is provided that includes a cable, a slack take-up mechanism, a cam, and a biasing member. The slack take-up mechanism is engageable with the cable and movable between a higher slack position and a lower slack position. The lower slack position causes the cable to exist in a relatively lower slack condition. The higher slack position allows the cable to exist in a relatively higher slack condition. The cam is operatively coupled to the slack take-up mechanism and to the drawer. The cam is adapted to switch the slack take-up mechanism from the higher slack position to the lower slack position when the drawer is moved in the first direction toward the open position. The biasing member is adapted to exert a force against the take-up mechanism that urges the slack take-up mechanism toward the lower slack position. The force of the biasing member may have a magnitude that is independent of the magnitude of the force exerted on the drawer in the first direction.

According to another aspect of the present invention a cabinet is provided. The cabinet includes at least one drawer, a frame, an elongated, flexible member, and an interlock. The interlock is adapted to prevent the drawer from opening when the elongated, flexible member is in the lower slack condition, and to allow the drawer to open when the flexible member is in the higher slack condition. The interlock includes a slack take-up mechanisms that changes the flexible member from the higher slack condition to the lower slack condition when the drawer is opened. The slack take-up mechanism is further adapted to exert a force on the elongated, flexible member that has a magnitude that is independent of a force applied in the first direction to the drawer.

According to still other aspects of the present invention, the interlock may be in communication with a lock that is adapted to selectively alter the condition of the cable. The interlocks may be secured to drawer slides that are removable from the cabinet. A cable guide may be included as part of the interlock to snap-fittingly receive the cable and retain it in engagement with the interlock.

The various aspect of the present invention provides an interlock and lock system that is versatile, resistant to high forces, and easily installed. These and other benefits of the present invention will be apparent to one skilled in the art in light of the following written description when read in conjunction with the accompanying drawings.

BRIEF DESCRIPTION OF THE DRAWINGS

FIG. 21 is a perspective view of a cable guide of the interlock of FIG. 3;

FIG. 22 is a bottom view of the cable guide of FIG. 21;

FIG. 23 is a plan view of the cable guide of FIG. 21;

DETAILED DESCRIPTION OF THE INVENTION

Figure 1:
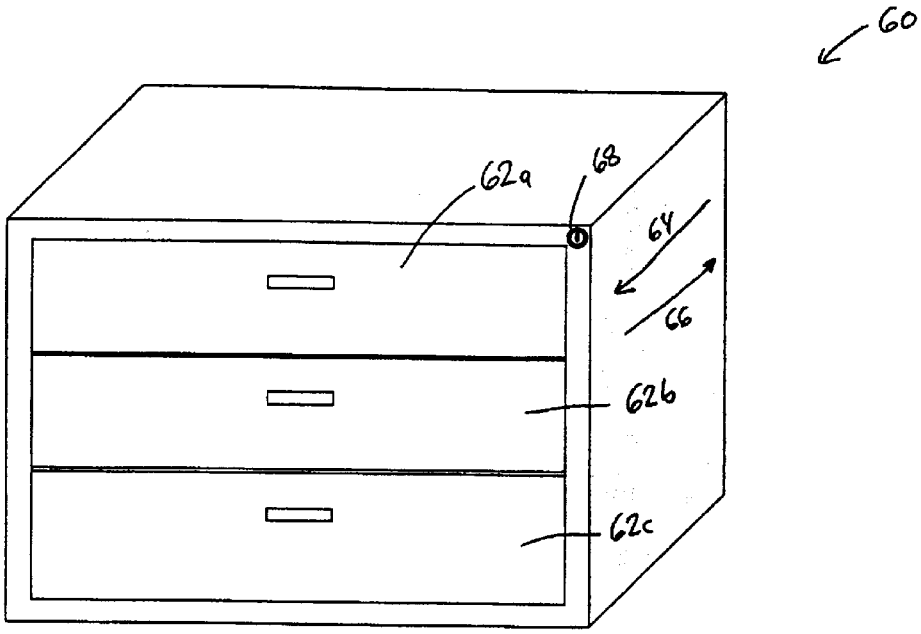
FIG. 1 is a perspective view of a cabinet with three drawers in a closed position.
Figure 2:
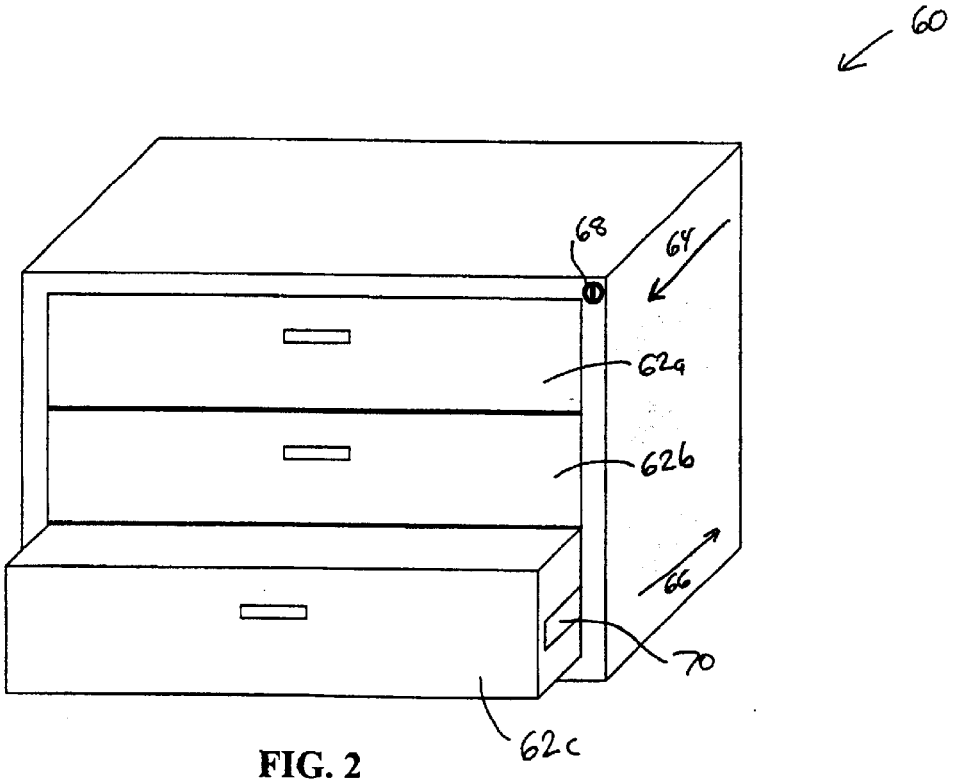
FIG. 2 is a perspective view of the cabinet of FIG. 1 illustrated with one drawer moved to an open position.

The present invention will now be described with reference to the accompanying drawings wherein the reference numerals in the following written description correspond to like numbered elements in the several drawings. The present invention relates to locks and interlocks that may be used with file cabinets, such as the file cabinet 60 depicted in FIGS. 1 and 2. File cabinet 60 includes three drawers 62*a–c* that are essentially stacked on top of each other in file cabinet 60. Each drawer can be pulled in a first direction 64 toward an open position. The lower most drawer 62c in FIG. 2 is illustrated in the open position. When it is time to close this drawer, it can be pushed in a second direction 66 back to its closed position. The interlocking system of the present invention prevents more than one drawer from being opened at a single time. While only three drawers are illustrated in file cabinet 60, the present invention is applicable to cabinets having any number of drawers. The present invention also includes a locking system that overrides the interlocking system. That is, when the locking system is activated, no drawers can be opened at any time. When the locking system is deactivated, the interlocking system is activated and prevents more than one drawer from being opened at a single time. The locking system may be activated by inserting a key into a keyhole 68 positioned at any suitable location on the file cabinet. The locking and interlocking system are highly integrated so that many of the components of the interlocking system are also used in the locking system.

The interlocks of the present invention may be advantageously combined or attached to the drawer slides in which drawers 62 slidingly move between their open and closed position. An example of one of these drawer slides 70 is depicted in FIG. 2 for the lower most drawer 62*c*. Each drawer 62 includes two drawer slides 70, one positioned on one side of the drawer and another positioned on the opposite side of the drawer. While the interlocks of the present invention can be placed at other locations besides on drawer slide 70, the attachment of the interlocks to the drawer slide 70 allows the interlocks to be simultaneously removed and repositioned when the drawer slides 70 are removed and repositioned. This greatly facilitates the reconfirmation of a file cabinet 60 with differently sized drawers 62.

Figure 3:
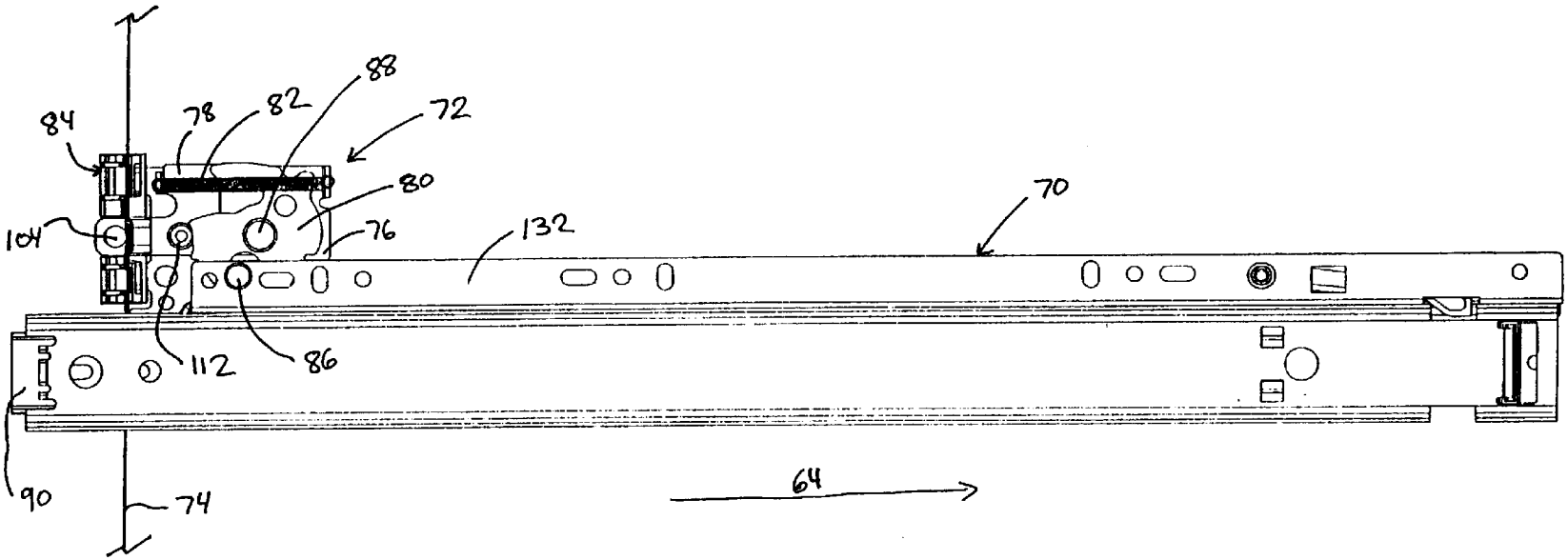
FIG. 3 is a side, elevational view of an interlock and drawer slide according to a first embodiment of the present invention.

An interlock 72 according to a first embodiment of the present invention is depicted in FIG. 3. Interlock 72 is attached to a drawer slide 70. Interlock 72 is operatively coupled to a cable 74 that runs vertically inside of cabinet 60. In general, interlock 72 operates according to the amount of slack in cable 74. Specifically, cable 74 has two different basic levels of slack. When no drawers are opened and the lock is not activated, cable 74 has a high amount of slack in it. When a single drawer is opened, interlock 72 takes up most or all of the slack in cable 74 and creates a second, lower level of slack in cable 74. The lower level of slack in cable 74 is such that no other drawers in the cabinet 60 can be opened. This lower level of slack may be zero, or may include a small amount of slack. When the open drawer is closed, more slack in the cable 74 returns and any other single drawer may thereafter be opened. If a lock is included with the cabinet 60, the lock is adapted to alter the slack in cable 74. When in the locked position, the lock removes most or all of the slack in cable 74. When in the unlocked condition, the lock allows cable 74 to have sufficient slack so that a single drawer may be opened. Interlocks 72 are thus designed to only allow their associated or attached drawer to be opened when cable 74 has sufficient slack. Further, they are designed to remove substantially all of the slack in cable 74, if their associated drawer is opened. The detailed construction of interlock 72, as well as how they accomplish the aforementioned functions, will now be described.

Figure 4:
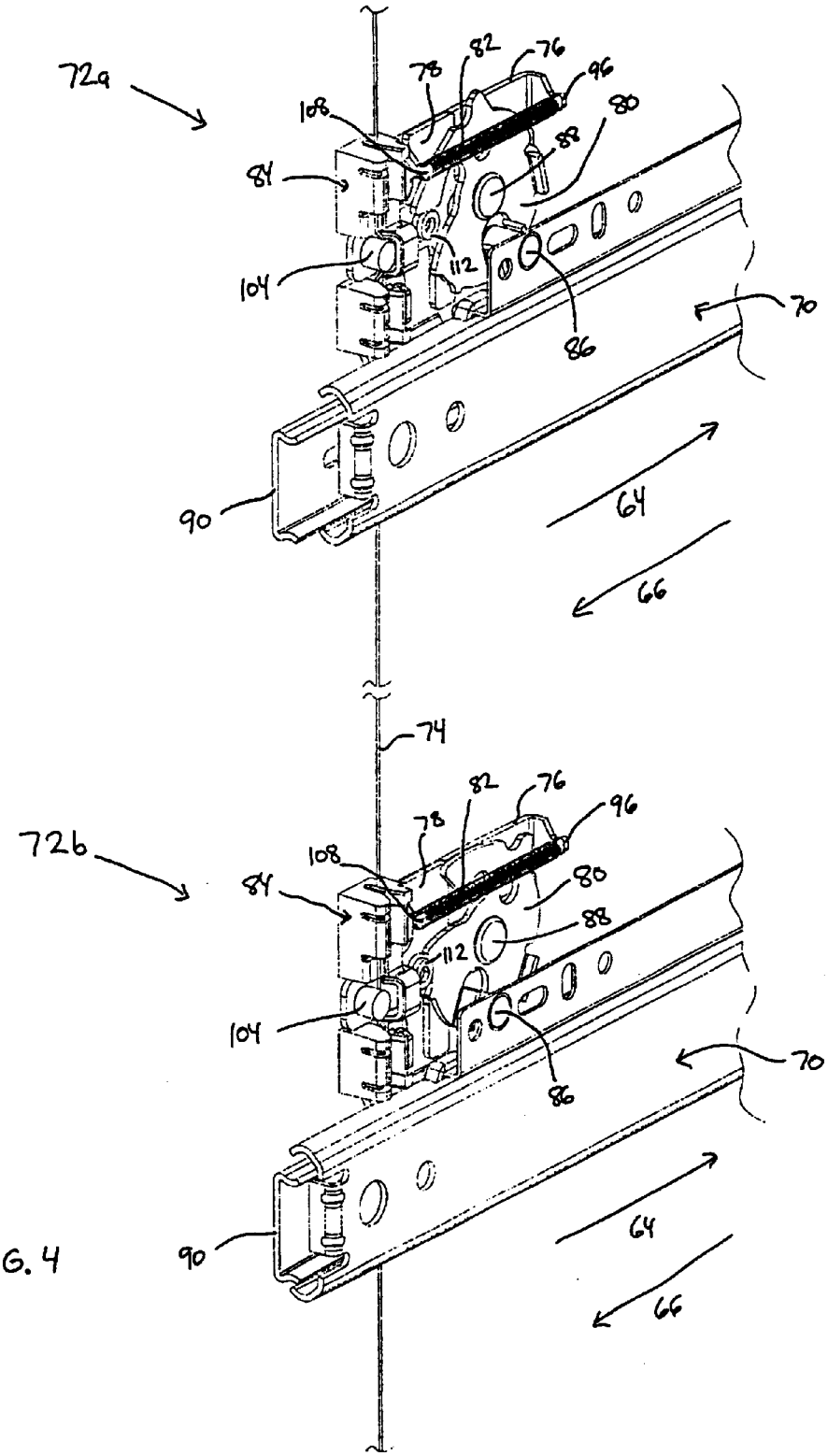
FIG. 4 is a perspective view of a pair of interlocks according to the first embodiment of the present invention.
Figure 5:
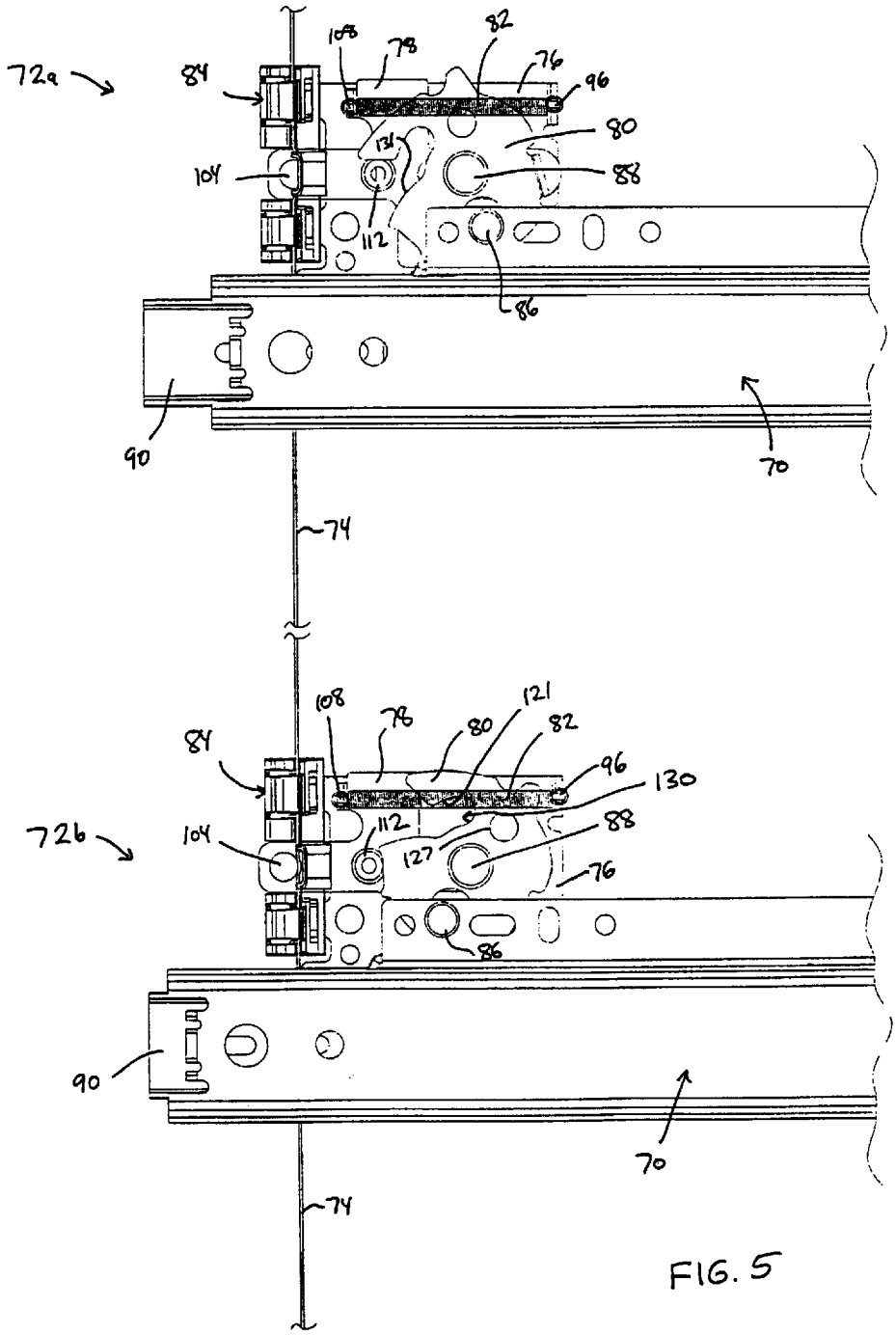
FIG. 5 is a side, elevational view of the pair of interlocks of FIG. 4.
Figure 6:
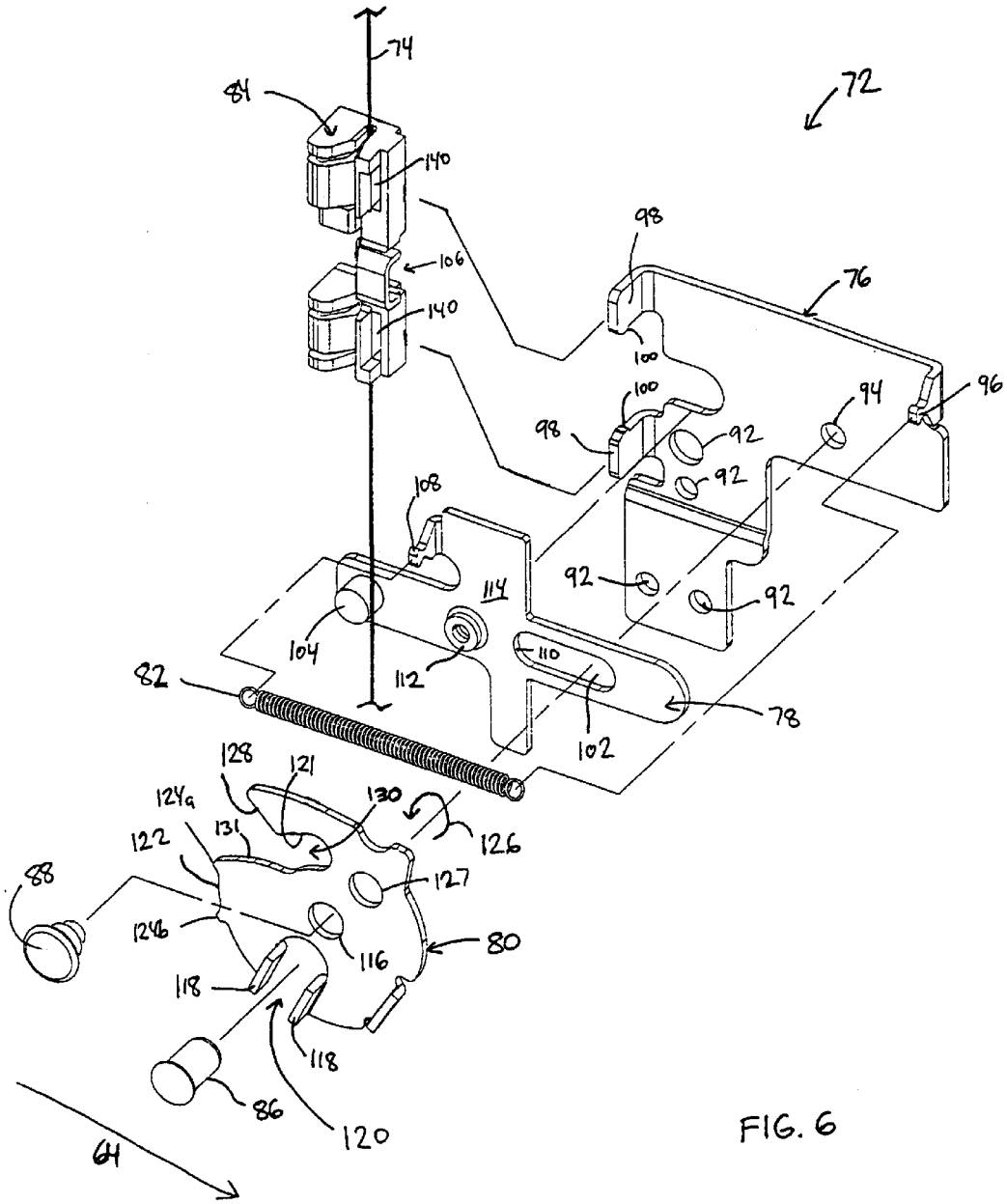
FIG. 6 is a perspective, exploded view of the interlock of FIG. 3.

As illustrated in FIG. 6, interlock 72 generally includes an attachment plate 76, a sliding plate 78, a rotatable cam or lever 80, a spring 82, a cable guide 84, an engagement member 86, and a rivet 88. Attachment plate 76 is a stationary part that secures interlock 72 to drawer slide 70. Specifically, attachment plate 76 is secured to a stationary portion 90 of drawer slide 70. Stationary portion 90 is illustrated in FIGS. 4 and 5. Stationary portion 90 is, in turn, secured to appropriate attachment structures within file cabinet 60. Those attachment structures may allow drawer slide 70 to be easily removed and repositioned inside of cabinet 60. Attachment plate 76 may be secured to stationary portion 90 of drawer slide 70 in any suitable fashion, such as by welding, or the use of fasteners.

Attachment plate 76 includes a plurality of fastener holes 92 which may be used to receive rivets, screws, or other fasteners to secure attachment plate 76 to stationary portion 90 of drawer slide 70. Attachment plate 76 is depicted in detail in FIGS. 6 and 8–10. Attachment plate 76 further includes a rivet hole 94 which receives rivet 88. Rivet 88 secures cam 80 to attachment plate 76 in a rotatable fashion. Stated alternatively, cam 80 is attached to attachment plate 76 in such a manner that it can rotate about the axis generally defined by rivet 88. Attachment plate 76 further includes a spring attachment nub 96 to which one end of spring 82 is attached. Attachment plate 76 also includes a pair of bent flanges 98. Bent flanges 98 are received inside of cable guide 84 and used to secure cable guide 84 to attachment plate 76. Each flange 98 includes a shoulder 100 that retains cable guide 84 on attachment plate 76 after they have been attached, as will be explained in more detail below.

Sliding plate 78, which is depicted in detail in FIGS. 6 and 11–13, is positioned between attachment plate 76 and cam 80. Sliding plate 78 slides linearly in a direction parallel to first and second directions 64 and 66. When a drawer 62 is initially opened, sliding plate 78 slides linearly in first direction 64. As the drawer fully closes, sliding plate 78 slides back to its original position in second direction 66. Sliding plate 78 includes an elongated aperture 102 that receives rivet 88. Because elongated aperture 102 has a length much greater than the diameter of rivet 88, sliding plate 78 can slide along rivet 88 while still being supported by rivet 88. Sliding plate 78 includes an engagement lug 104 positioned at an end generally opposite to elongated aperture 102. Engagement lug 104 engages cable 74 generally along its side that faces toward elongated aperture 102. The side of sliding plate 78 adjacent engagement lug 104 is supported in a channel 106 defined by cable guide 84. When sliding plate 78 slides in first direction 64, engagement lug 104, which is in engagement with cable 74, decreases the slack in cable 74. Thus, when a drawer is open, sliding plate 78 and engagement lug 104 remove most or all of the slack from cable 74. This will be described in more detail below.

Sliding plate 78 further includes a spring attachment nub 108. Spring attachment nub 108 is used to attach the other end of spring 82 to sliding plate 78. When spring 82 is connected between attachment nubs 108 and 96, spring 82 exerts a force that tends to urge attachment nubs 96 and 108 toward each other in a direction generally parallel to first direction 64. The movement of sliding plate 78 toward spring attachment nub 96 of attachment plate 76 is limited by an interior surface 110 of elongated aperture 102. When interior surface 110 contacts rivet 88, sliding plate 78 can no longer be moved any further in first direction 64. As will be described in more detail herein, spring 82 exerts the slack-removal force on cable 74, by way of engagement lug 104 when a drawer is opened. Depending on the physical construction of interlock 72, as well as the type of cable 74 chosen, spring 82 may be desirably chosen to exert a force against sliding plate 78 of one to two pounds in a first direction 64 when a drawer is open. Other amounts of force can also be used within the scope of the present invention. The amount of this force should be sufficient to overcome the cumulative friction between the cable and all of the parts it is in contact within interlock 72, as well as the other interlocks within the cabinet. Stated alternatively, spring 82 should be sufficiently strong to remove or reduce the slack in cable 82 by pulling sliding plate 78 sufficiently far in first direction 64 to allow an embossment 112, described below, to fit into a channel 120 on cam 80. Once positioned therein, a surface 121 in channel 130 prevents sliding plate 78 from retreating in second direction 66 until the drawer is closed. This retains cable 74 in a low slack condition whenever any other drawers are attempted to be opened.

As mentioned, sliding plate 78 further includes an embossment 112 on a side 114 that faces cam 80. Embossment 112 is positioned between elongated aperture 102 and engagement lug 104. Embossment 112 interacts with cam 80 in a manner that will be described in more detail herein. In general, cam 80 acts as a switch for moving sliding plate 78 between a slack-removal position, in which a force is exerted on cable 74, and a slack position, in which no force is exerted on cable 74. This switching occurs when the drawer associated with interlock 72 is opened or closed. This switching utilizes embossment 112, as explained more below.

Cam 80, which is depicted in more detail in FIGS. 6 and 14–16, includes a central aperture 116 which receives rivet 88. As mentioned previously, cam 88 is rotatable about rivet 88. Cam 80 includes a pair of spaced flanges 118 that define a channel 120 therebetween. Channel 120 selectively receives engagement member 86. Engagement member 86 is attached to the drawer 62 such that it will move linearly in first direction 64 when the drawer is open, and in second direction 66 when the drawer is closed. Cam 80 translates this linear motion into a rotational motion. Cam 80 includes a first surface 122 that engages embossment 112 whenever the associated drawer is fully closed. Raised shoulders 124*a* and *b* are defined adjacent each end of first surface 122. Raised shoulders 124*a* and *b* tend to maintain embossment 112 on first surface 112 and thereby resist inadvertent rotation of cam 80.

From the position illustrated in FIG. 6, cam 80 is generally rotatable in a direction 126. This rotation in direction 126 is activated by the associated drawer being pulled toward the open position. When the drawer is so pulled, engagement member 86 begins to move in first direction 64. Because engagement member 86 is housed within channel 120, this movement in first direction 64 causes cam 80 to begin to rotate in direction 126. As this rotation continues, raised shoulder 124*a* of cam 80 comes into contact with embossment 112. In order for the rotation of cam 80 to continue, sliding plate 78 must be pushed in second direction 66 a small amount in order to provide clearance for embossment 112 to overcome shoulder 124*a*. Shoulder 124*a* is an optional feature that, if provided, helps to ensure that the drawer stays shut after it is closed. If the drawer is shut hard enough to create a rebounding force that would otherwise cause the drawer to open back up again, at least partially, shoulder 124*a* provides sufficient resistance to generally prevent this rebounding force to open the drawer. Shoulder 124*a* thus serves to maintain a drawer in the closed position until a user exerts sufficient force on a drawer to move embossment 112 past shoulder 124*a*.

Figure 7:
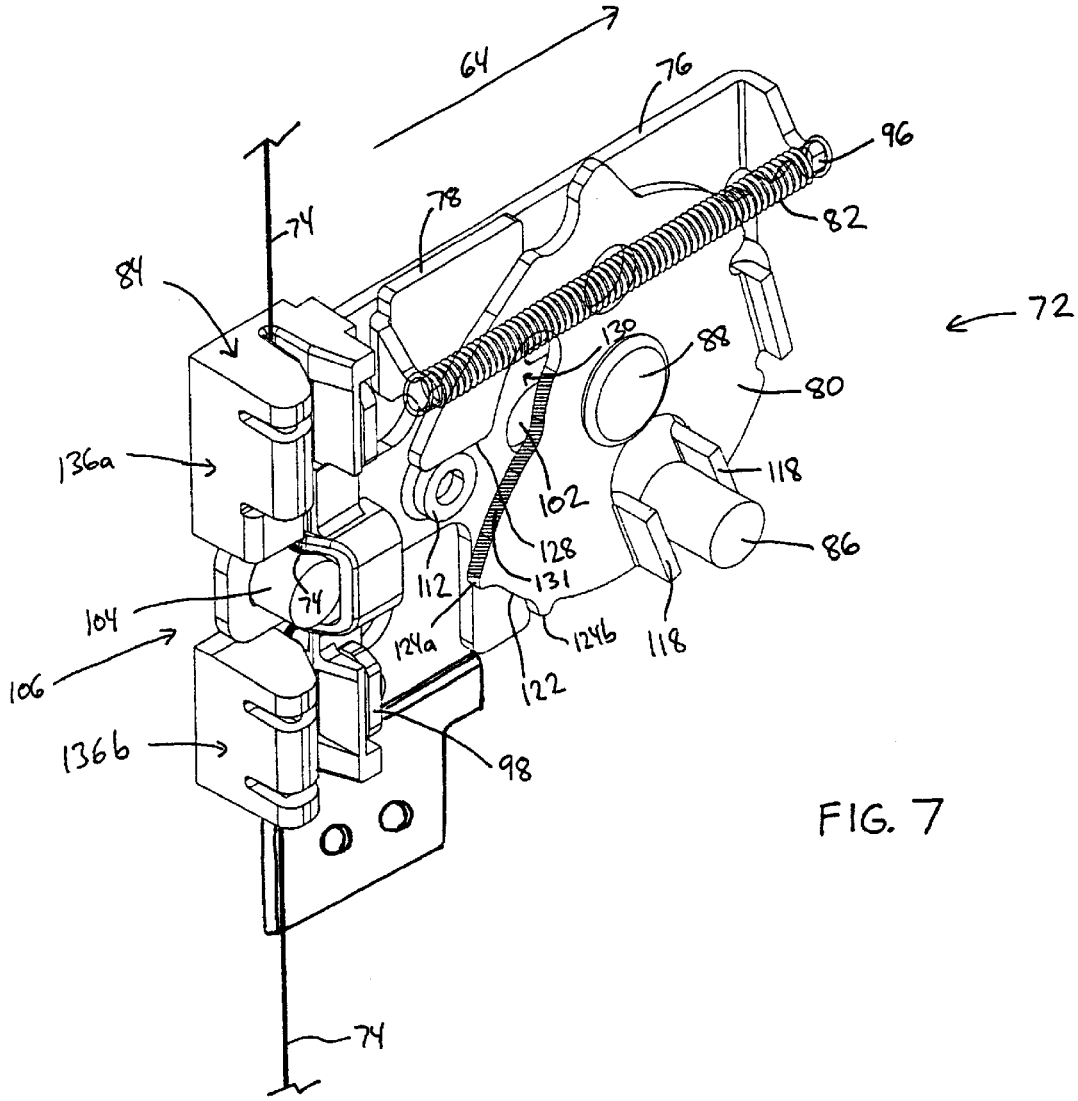
FIG. 7 is a perspective view of the interlock of FIG. 3 illustrated without a drawer slide attached.
Figure 8:
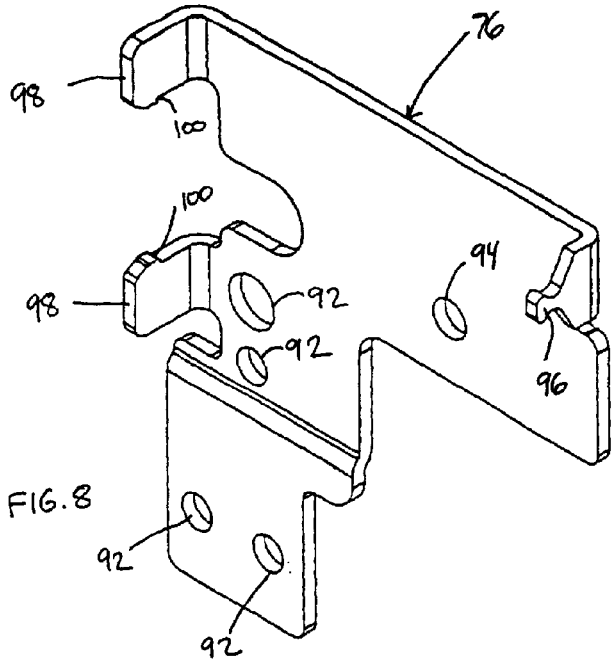
FIG. 8 is a perspective view of an attachment plate of the interlock of FIG. 3.
Figure 9:
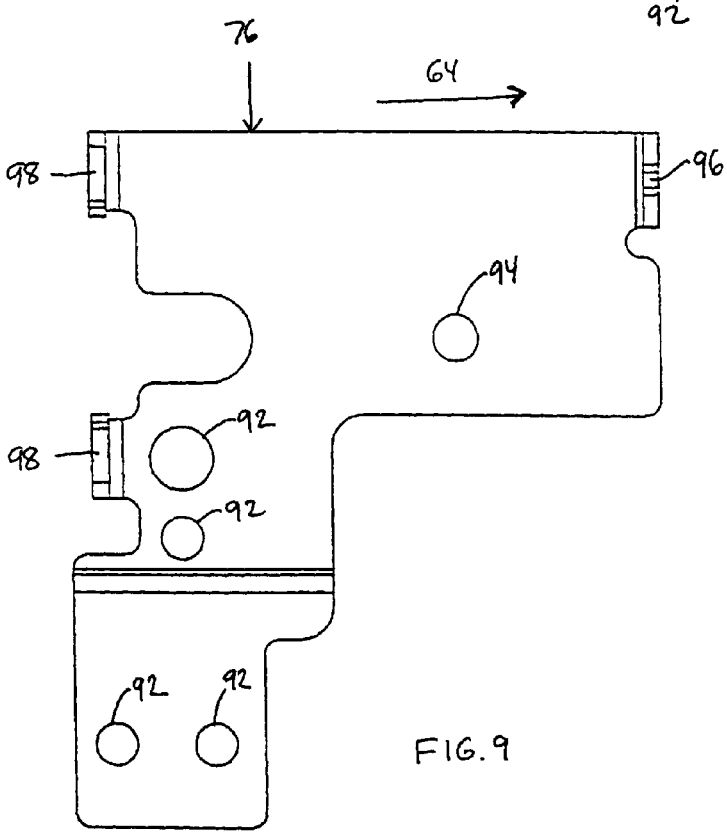
FIG. 9 is a plan view the attachment plate of FIG. 8.
Figure 10:
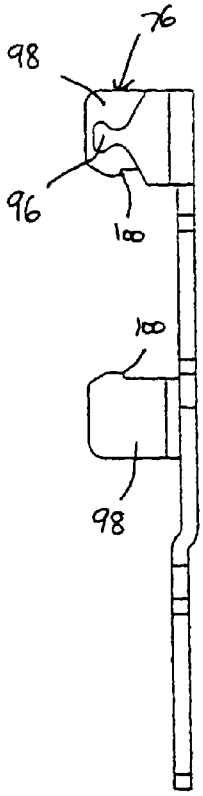
FIG. 10 is a side, elevational view of the attachment plate of FIG. 8.
Figure 11:
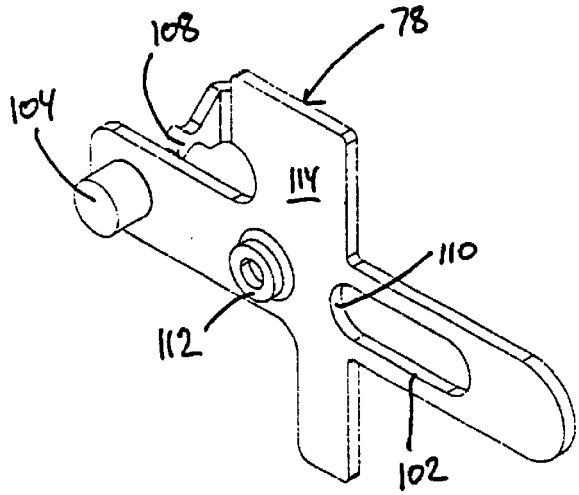
FIG. 11 is a perspective view of a sliding plate of the interlock of FIG. 3.
Figure 12:
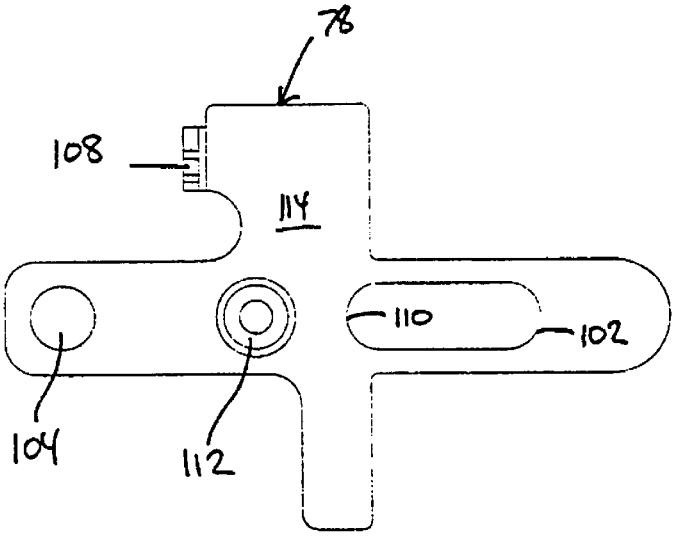
FIG. 12 is a plan view of the sliding plate of FIG. 11.
Figure 13:
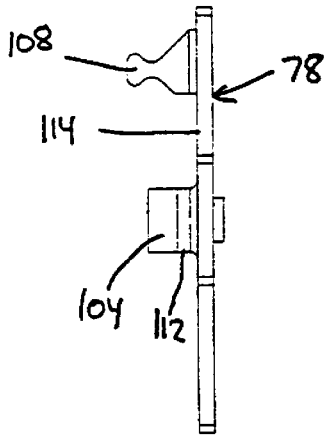
FIG. 13 is a side, elevational view of the sliding plate of FIG. 11.

After embossment 112 has overcome raised shoulder 124*a*, the force of spring 82 tends to pull sliding plate 78 in first direction 64. If cable 74 is in a low slack condition, however, sliding plate 78 will not be able to move in first direction 64 because engagement lug 104 will be prevented from moving in first direction 64 by the low slack cable. If the cable has little slack, further rotation of cam 80 in direction 126 will only be able to continue until a stop surface 128 on cam 80 abuts against embossment 112. This condition is illustrated in FIG. 7. Once stop surface 128 comes into contact with embossment 112, further rotation of cam 80 in direction 126 is impossible. The degree of rotation of cam 80 when embossment 112 is in engagement with stop surface 128 is insufficient to allow engagement member 86 to exit from channel 120. If a person attempts to open the associated drawer, the force they exert in the first direction will be transferred from engagement member 86 to cam 80. Cam 80 will transfer this force to embossment 112 via its contact with stop surface 128. Due to the construction of cam 80, the force exerted by stop surface 128 against embossment 112 will generally be a vertical force that is perpendicular to first direction 64. The force exerted on sliding plate 78 through embossment 112 will therefore not tend to move sliding plate 78 in either first direction 64 or second direction 66. The pressure of stop surface 128 against embossment 112 will therefore not create any forces on engagement lug 104. Cable 74 is therefore shielded from the forces exerted on the drawer when the cable is in a low slack condition. Surface 121 of channel 120 prevents cable 74 from pulling plate 78 in direction 66 as another drawer is attempted to be opened.

If cable 74 is not in a low slack condition when cam 80 rotates in direction 126, then sliding plate 78 will be free to move in first direction 64 after embossment 112 has cleared raised shoulder 124*a*. This movement of sliding plate 78 in first direction 64 will cause embossment 112 to also move in first direction 64. This movement of embossment 112 will allow it to fit into a channel 130 defined on cam 80. Channel 130 is suitably dimensioned to allow cam 80 to continue to rotate until channel 120 is angled enough to allow engagement member 86 to exit channel 120. Thus, the drawer can be opened. The movement of embossment 112 into channel 130, which is caused by the biasing force of spring 82, will also cause engagement lug 104 to move in first direction 64. The movement of engagement lug 104 in first direction 64 will remove the slack in cable 74 and change the cable to a low slack condition. No other drawers will therefore be able to be opened simultaneously.

When the associated drawer is closed, engagement member will cause cam 80 to rotate in a direction opposite to the direction of its rotation when the drawer is opened. This closing rotation will cause a surface 131 on cam 80 to engage embossment 112. This engagement pushes embossment 112, and consequently sliding plate 74 in second direction 66. In order to avoid requiring excessive force to close the drawer, surface 131 may be angled at about 45 degrees when it contacts embossment 112. This allows sliding plate 78 to be pushed in second direction 66 without excessive forces.

Figure 17:
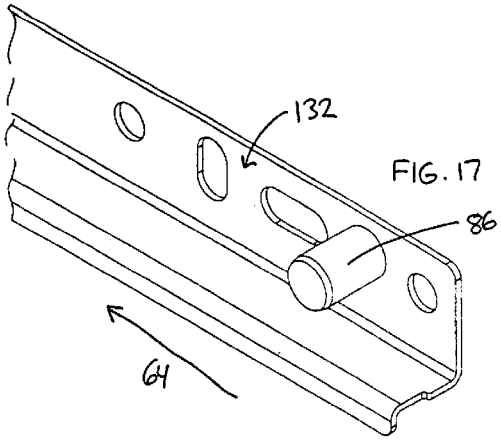
FIG. 17 is a perspective view of an engagement member of the interlock of FIG. 3.
Figure 18:
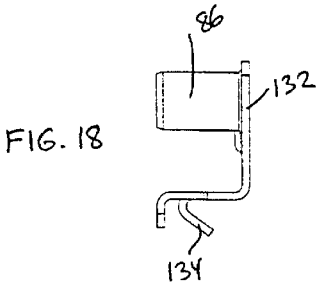
FIG. 18 is a front, elevational view of the engagement member of FIG. 17.
Figure 19:
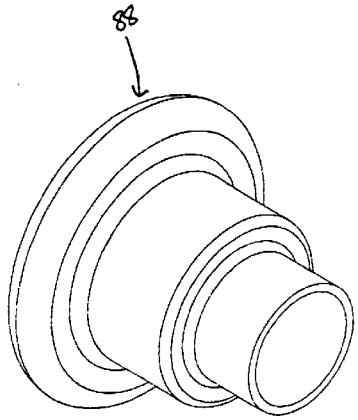
FIG. 19 is a perspective view of a rivet of the interlock of FIG. 3.
Figure 20:
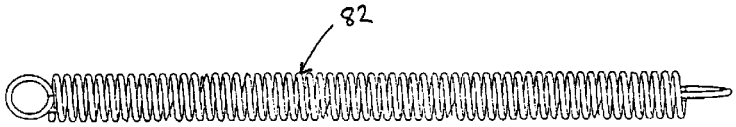
FIG. 20 is a side, elevational view of a spring of the interlock of FIG. 3.

Engagement member 86, which is depicted in more detail in FIG. 17, is attached to an elongated member 132. Elongated member 132 is fixedly secured to the drawer. Elongated member 132 is positioned on top of the drawer slide 70. Elongated member 132 includes various apertures that may be used to secure it to the drawer 62. Elongated member 132 includes a lower flange 134 that may be used to mount member 132 to drawer slide 70 (FIG. 18). Rivet 88 and spring 82 are depicted in FIGS. 19 and 20, respectively.

Cable guide 84, which is depicted in more detail in FIGS. 21–23 serves to ensure that cable 74 is properly maintained in contact with engagement lug 104 of sliding plate 78. Cable guide 74 may be manufactured of molded plastic. Cable guide 84 preferably snap-fittingly receives cable 84 so that cable 74 may be easily threaded into guide 84 with little danger of cable 74 becoming unthreaded. Cable guide 84 includes an upper and lower portion 136*a* and *b*. Channel 106 is defined between upper and lower portions 136*a* and *b*. As has been described, channel 106 provides clearance for sliding plate 78 and engagement lug 104. Cable guide 84 includes two glide surfaces 138 that provide support to sliding plate 78. Each portion 136*a* and *b* further includes an aperture 140. Apertures 140 receive bent flanges 98 of attachment plate 76 when cable guide 84 is attached thereto.

Apertures 140 are spaced apart in a vertical direction a distance that is slightly smaller than the vertical distance between shoulders 100 on flanges 98 of attachment plate 76. Thus, when flanges 98 are inserted into apertures 140, shoulders 100 contact and press against inner surfaces 142 of apertures 140. The dimensions of shoulders 100 force inner surfaces 142 to flex inwardly towards each other. When flanges 98 have been completely inserted into apertures 140, shoulders 100 have moved past inner surfaces 142, allowing them to flexibly snap back to their unstressed position. Shoulders 100 contact surfaces 144 of cable guide 84. Shoulders 100 thus prevent flanges 98 from being retracted out of apertures 140 without flexing inner surfaces 142 towards each other. Because shoulders 100 do not have a cam surface that facilitates removal of flanges 98 from apertures 140, cable guide 84 is securely retained on flanges 98 of attachment plate 76. After cable guide 84 is secured to flanges 98, sliding plate 78 is inserted into channel 106 between top and bottom portions 136*a* and *b* of cable guide 84. When sliding plate 78 is so positioned in channel 106, top and bottom portions 136*a* and *b* are substantially prevented from flexing toward each other by sliding plate 78's contact with glide surfaces 138. Cable guide 84 is therefore securely retained on attachment plate 76.

Cable 74 is easily threaded into cable guide 84 by moving cable 74 in direction 146 into channel 106 (FIG. 21). Movement of cable 74 in this direction causes the cable 74 to come in contact with two flexible arms 148. As cable 74 is further pushed against flexible arms 148, flexible arms 148 begin to flex out of the way until sufficient clearance is provided for cable 74 to pass by flexible arms 148. As soon as cable 74 passes by arms 148, they snap back to their unflexed condition. In this unflexed condition, cable 74 is prevented from being retracted out of cable guide 84 in a direction opposite the direction 146 by flexible arms 148. If an interlock 72 is to be removed from the inside of a cabinet, cable 74 can be easily removed from cable guide 84 by manually pressing flexible arms 148 in direction 146. Flexible arms 148 are pressed until sufficient clearance is provided for cable 74 to be retracted out of guide 84 in a direction generally opposite to direction 146.

FIGS. 4 and 5 illustrate a pair of interlocks 72*a* and *b* in different conditions. The cable 74 in FIGS. 4 and 5 is in a low slack condition. The drawer that is attached to the drawer slide of interlock 72*b* is in a closed position. As has been described previously, first surface 122 of cam 80 is in contact with embossment 112 in this position. The drawer corresponding to interlock 72*a* illustrates the condition of interlock 72*a* when this drawer is trying to be opened and cable 74 is already in a low slack condition due to either a lock or another interlock having its drawer open (not shown). Because cable 74 is in a low slack condition, engagement lug 104 of sliding plate 78 (of interlock 72*a*) is prevented from moving further in first direction 64 than that illustrated in FIGS. 4 and 5. Because sliding plate 78 cannot move further in first direction 64, embossment 112 of sliding plate 78 cannot move out of the way of stop surface 128 on cam 80. Embossment 112 thus prevents cam 80 from further rotation while cable 74 is in the low slack condition. Because cam 80 cannot rotate any further, engagement member 86 cannot disengage from channel 120 of cam 80. The drawer therefore cannot be opened. As noted, cable 74 of FIGS. 4 and 5 is in the low slack condition due to another interlock with an opened drawer (not shown) that is in communication with cable 74. Alternatively, cable 74 could be in the low slack condition because it is in communication with a lock that has moved to the locking position. FIG. 7 also illustrates an interlock 72 for a drawer that is trying to be opened when cable 74 is in the low slack condition. Again, the low slack condition of cable 74 is due to either a lock or another interlock that is not shown in FIG. 7.

Figure 24:
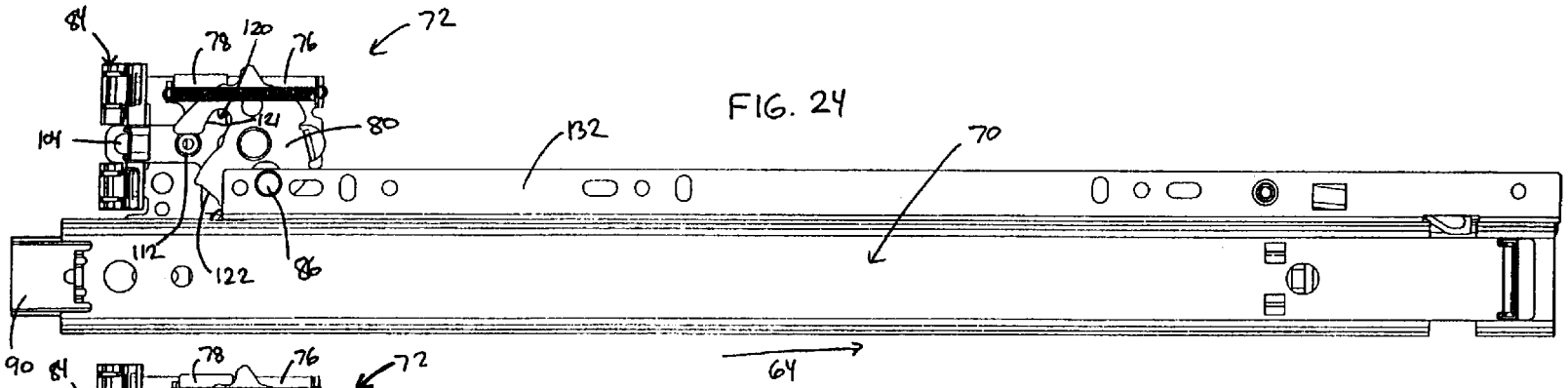
FIG. 24 is a side, elevational view of the interlock and drawer slide of FIG. 3 illustrated with the interlock in a locked position.

FIGS. 3 and 24–27 illustrate interlock 72 in its various positions according to different drawer conditions. FIG. 3 illustrates interlock 72 when the associated drawer is closed. FIG. 24 illustrates interlock 72 when the cable 74 has been changed to the low slack condition by an unillustrated interlock or lock and the drawer associated with interlock 72 is trying to be pulled open. The drawer is prevented from being opened by the engagement of stop surface 128 with embossment 112. Because stop surface 128 presses vertically down on embossment 112, sliding plate 78 does not experience a linear force in either first or second direction 64 or 66. Whatever force is exerted against the drawer in first direction 64 is therefore not translated to cable 74. Rather, cable 74 only experiences a tensioning force from interlock 72 that is due to spring 82 acting to pull engagement lug 104 in first direction 64. The tensile strength of cable 74 therefore does not appreciably limit the amount of force that can be applied to trying to open the locked door before the interlock system fails. Interlock 72 of the present invention may resist up to 150 pounds of force on a drawer, or more, before it fails. Further, this failure point will be due to cam 80 and its interaction with either embossment 112 or engagement member 86, not the tensile strength of cable 74. Interlock 72 thus shields cable 74 from the forces that are applied in first direction 64 to open locked drawers.

Figure 25:
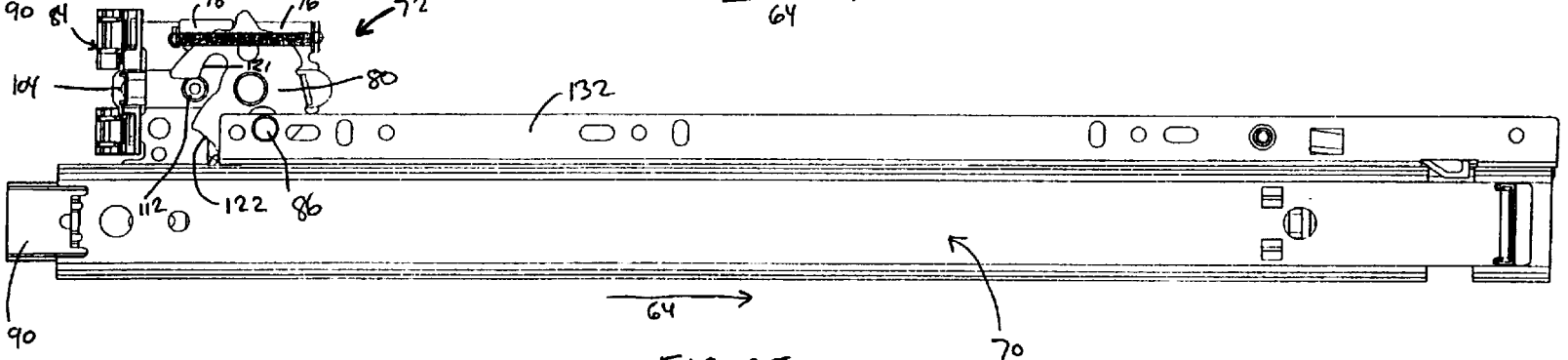
FIG. 25 is a side, elevational view of the drawer slide and interlock of FIG. 3 illustrating the interlock in a position in which two drawers are being simultaneously pulled toward an open position.

FIG. 25 depicts interlock 72 in the position it would move to when a person was trying to simultaneously open two drawers in the cabinet. Because no single drawer is fully open, cable 74 includes sufficient slack to allow embossment 112 to almost move past stop surface 128. However, embossment 112 cannot totally clear stop surface 128, and neither drawer will be able to be opened in this situation due to the partial engagement of stop surface 128 with embossment 112.

Figure 14:
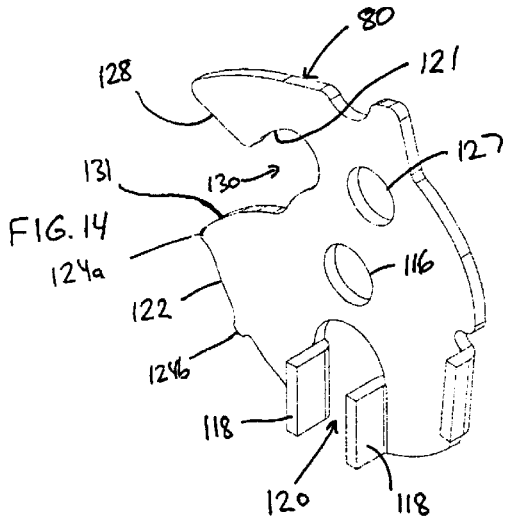
FIG. 14 is a perspective view of a cam of the interlock of FIG. 3.
Figure 15:
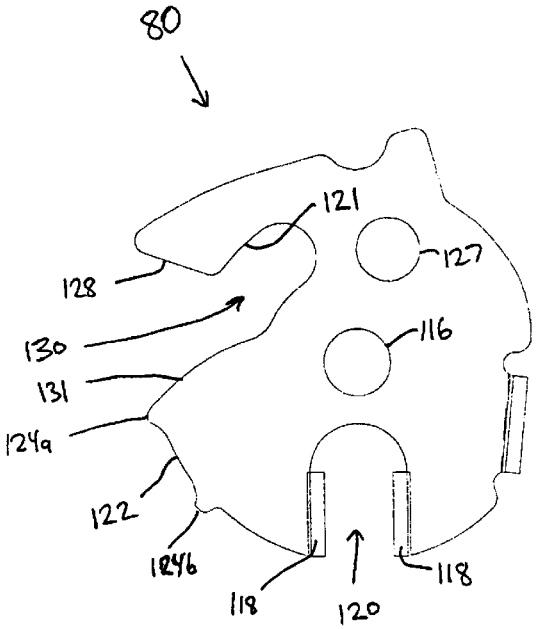
FIG. 15 is a plan view of the cam of FIG. 14.
Figure 16:
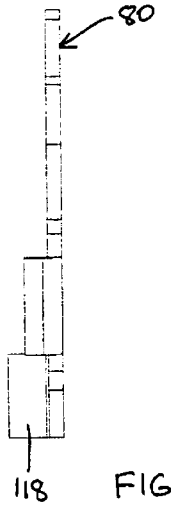
FIG. 16 is a side, elevational view of the cam of FIG. 14.
Figure 26:
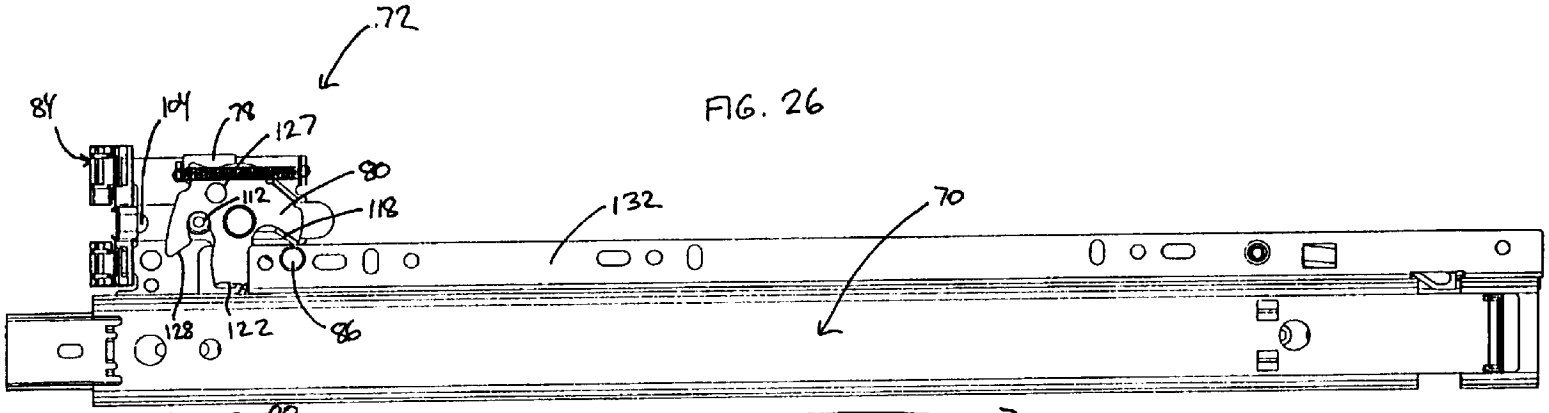
FIG. 26 is a side, elevational view of the drawer slide and interlock of FIG. 3 illustrating the interlock in an open position with the drawer slide contacting the cam.
Figure 27:
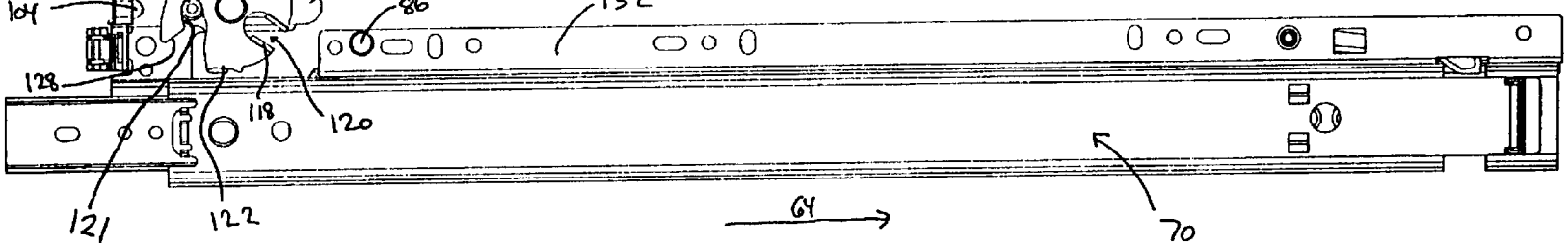
FIG. 27 is a side, elevational view of the drawer slide and interlock of FIG. 3 illustrating the interlock in an unlocked position, and the drawer slide disengaged from the cam.
Figure 28:
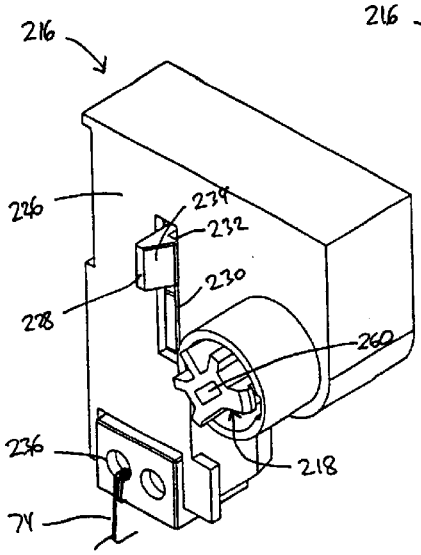
FIG. 28 is a perspective view of a lock illustrated in a locked position.
Figure 29:
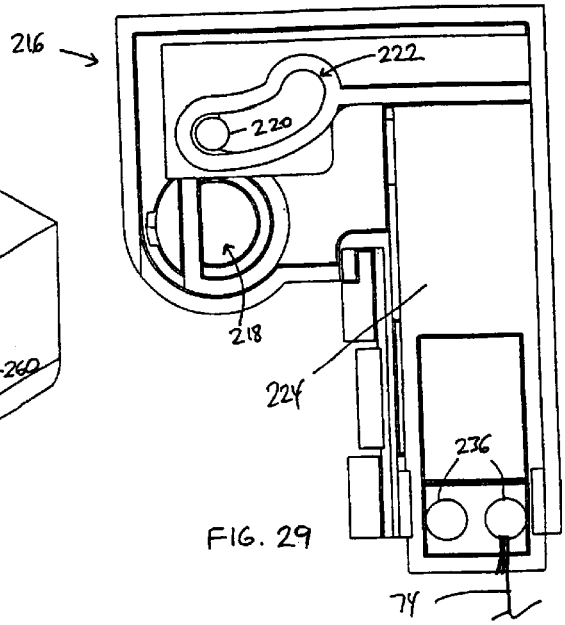
FIG. 29 is a side, elevational view of the lock of FIG. 28 in the locked position.

FIG. 26 illustrates an interlock 72 in which the drawer associated with interlock 72 is partially open. As can be seen, embossment 112 has moved into channel 130 of cam 80. This has allowed cam 80 to rotate sufficiently to allow engagement member 86 to disengage from cam 80. The complete disengagement of engagement member 86 from cam 80 is illustrated in FIG. 27. FIG. 27 illustrates the condition of interlock 72 when the drawer is open to a greater extent than that depicted in FIG. 26. When the drawer of interlock 72 is moved back to its closed position, cam 80 must be oriented so that engagement member 86 can slide back into channel 120. In order to prevent cam 80 from inadvertently rotating out of this orientation while the drawer is fully opened, cam 80 can be appropriately weighted so that it is unlikely to rotate when engagement member 86 is disengaged. This weighting can be adjusted by cutting holes in cam 80 at appropriate locations to remove weight, such as hole 127 (FIGS. 14–16). Another flange, such as flange 129 (FIGS. 14–16) may also be added to increase the weight of cam 80 on a selected side of its pivot axis. Flange 129 may also be used to provide additional structural strength to cam 80 to help resist excessive pulling forces from engagement number 86 when the drawer is locked, but being attempted to be opened.

Figure 30:
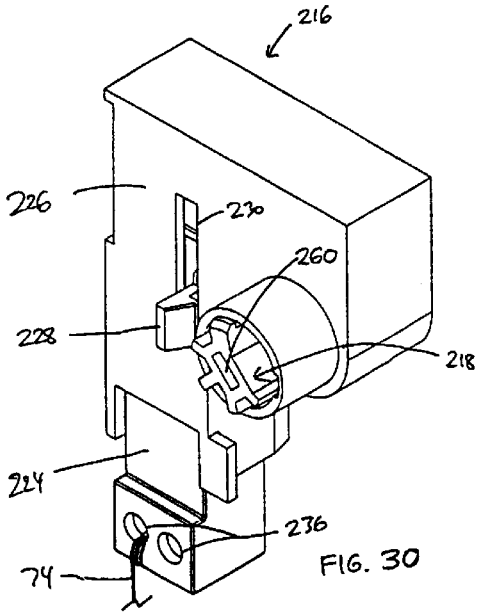
FIG. 30 is a perspective view of the lock of FIG. 28 illustrated in an unlocked position.
Figure 31:
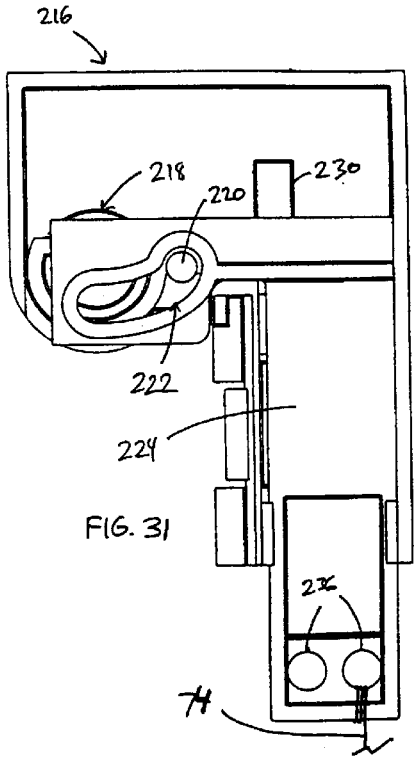
FIG. 31 is a side, elevational view of the lock of FIG. 30 in the unlocked position.
Figure 32:
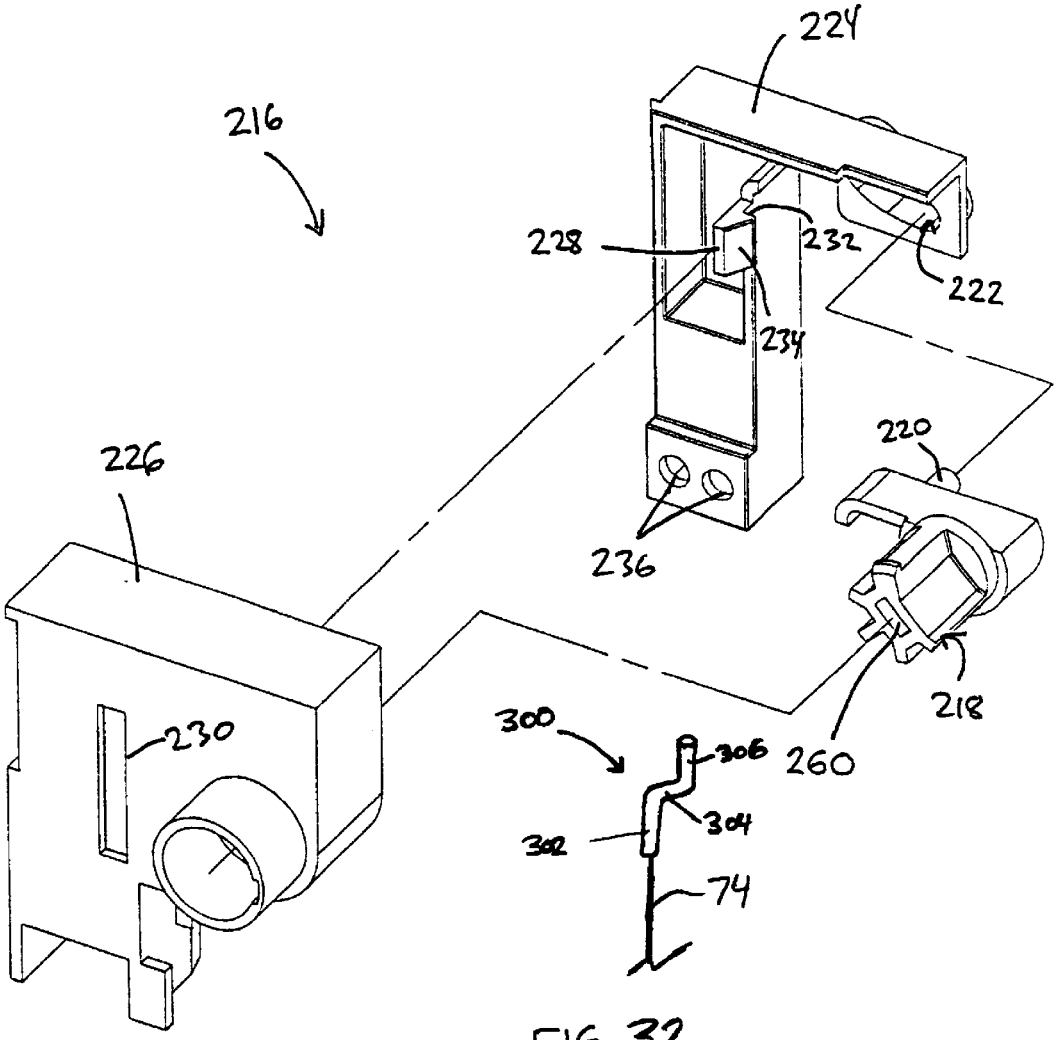
FIG. 32 is a perspective, exploded view of the lock of FIG. 28.

An example of a lock 216 that may be used in conjunction with the present invention is depicted in FIGS. 30–32. Lock 216 selectively changes the condition of cable 74 from a high slack condition to a low slack condition. Lock 216 includes a hole 260, which may be a keyhole, into which a key may be inserted, or which may receive a bar that is coupled to a conventional lock cylinder. If hole 260 is a keyhole, insertion of the proper key therein allows a key cylinder 218 to be rotated by the key. If hole 260 receives a bar, which may be desirable where lock 216 is positioned at the back end of the cabinet, the bar is coupled to any conventional lock in a manner that causes the bar to be able to rotate about its longitudinal axis when the proper key is inserted into the conventional lock. In either situation, key cylinder 218 therefore will rotate when a proper key is used. Key cylinder 218 includes a pin 220 that moves in a cam track 222 defined in a reciprocating member 224. Reciprocating member 224 is snap-fittingly attached to a cover 226 by way of a flexible arm 228. Flexible arm 228 fits into an aperture 230 defined in cover 226. Flexible arm 228 includes a shoulder 232 that retains reciprocating member 224 to cover 226 when the two are snap fit together. The snap fitting occurs when flexible arm 228 initially contacts cover 226. A cam surface 234 causes flexible arm 228 to flex as reciprocating member 224 is initially pushed toward cover 226. After the two are completely secured together, flexible arm 228 snaps back to its unflexed condition in which shoulder 232 prevents the two members from being separated.

Reciprocating member 224 includes a pair of apertures 236. Cable 74 may be secured to one of the apertures 236. When key cylinder 218 is rotated toward a locking condition, reciprocating member 224 moves vertically upward with respect to cover 226 (FIGS. 30–31). This vertical movement decreases the slack in cable 74 such that no drawers in the cabinet may be opened. When lock 216 is unlocked, the unlocking rotation of key cylinder 218 moves reciprocating member 224 vertically downward with respect to cover 226 (FIG. 32). This creates sufficient slack in cable 74 for a single drawer to be opened. Cover 226 may be securely fastened inside of cabinet 60 in any suitable manner.

Cable 74 may be secured to one of apertures 236 by threading the cable therethrough and tying it, such as is illustrated in FIGS. 28–31. Alternatively, a more preferred method of securing cable 74 to apertures 236 is accomplished by way of a J-hook 300 (FIG. 32). J-hook 300 is crimped onto an end of cable 74 in a conventional manner. J-hook 300 includes a lower vertical section 302, a middle horizontal section 304, and an upper vertical section 306. Upper vertical section 306, along with a portion of horizontal section 304, is inserted through one of apertures 236 and manipulated until upper vertical section 306 contacts one side of the wall in which apertures 236 are defined and is oriented vertically. In this position, horizontal section 304 passes horizontally through the aperture 236 and lower vertical section 302 abuts against a side of the wall in which aperture 236 is defined that is opposite the side contacting upper section 306. In this position, J-hook 300 is maintained in aperture 236 and can only be released by manually twisting J-hook 300 appropriately to allow upper section 306 to be backed out of aperture 236. J-hook 300 thus provides a convenient way for installing and removing cable 74 from lock 216.

The opposite end of cable 74 may also be fastened within a cabinet by using a J-hook that fits through an aperture attached to the cabinet, although any other method of securing cable 74 can be used with the present invention. If it is desired to avoid having an end of cable 74 be attached to the frame of the cabinet, it could alternatively be held in place by interacting with cable guide 84. Specifically, an enlarged ring or other structure could be affixed to the end of the cable. This enlarged structure would be dimensioned so that it was too large to pass through the cable passageway defined in cable guide 84. For securing the bottom of the cable, the enlarged structure would thus abut against a bottom surface 310 of the lower-most cable guide 84 (FIGS. 21–23). If it were desired to secure the top end of the cable in a like manner to a cable guide 84, rather than to a lock 216, an enlarged structure could also be attached to the top end of cable 74. In this situation, the enlarged structure would abut against a top surface 312 of the uppermost cable guide 84. The enlarged structure may preferably be shaped to snap onto, or otherwise be secured to, cable guide 84. If an enlarged structure were used on both ends of the cable to secure it in the cabinet, the proper cable slack could be set by manufacturing the cable to the specific length that created the desired amount of slack.

Lock 216 could be modified so that reciprocating member 224 utilized a spring or other structure that selectively increased or decreased the tension on cable 74. In other words, rather than having reciprocating member 224 absolutely move to is raised position when the key is rotated to the locked position, lock 216 could be modified to include a spring, or other biasing force, that urged member 224 towards its upper, locked position. If no drawers were open, this biasing force would be sufficient to raise member 224 to its locked position. If one drawer were open, this biasing force would be insufficient to move the member 224 to its upper position because the cable would be in its low slack condition, thereby preventing member 224 from moving upward while the drawer was opened. As soon as a drawer was closed, however, the biasing force would move member 224 to is locked position and remove the slack in the cable that was created by the drawer closing. This arrangement allows the lock to be switched to the locked position while a drawer is still open. Once the drawer closed, it would immediately be locked and not able to be opened until the lock 216 was deactivated. The modified lock 216 thus would allow the cabinet to be locked while a drawer was still open, and as soon as the open drawer was closed, it would immediately lock. Thereafter, no drawers could be opened until the lock was deactivated. The biasing force exerted on reciprocating member 224 in modified lock 216 should be sufficient to remove the slack in cable 74 when all the drawers are closed and to maintain the cable in the locked, low slack condition when pulling forces are exerted against one or more locked drawers.

Lock 216 may be further modified to include a solenoid, or other electrically controlled switch, that controls the movement of reciprocating member 224 between its locked and unlocked position. The solenoid could be controlled remotely by a user using a hand-held device that transmitted wireless signals to a receiver in the cabinet that controlled the solenoid. The control could be carried out in a conventional manner, such as in the manner in which remote, keyless entry systems work on many current automobiles. Alternately, the cabinet could include a keypad, or other input device, in which the locking or unlocking of the cabinet was controlled by information, such as a code or password, input by a user.

While other materials may be used, interlock 72 may be made primarily of metal. Specifically, attachment plate 76, sliding plate 78, cam 80, and rivet 88 may all be made of metal, such as steel, or any other suitable metal. Engagement member 86 may be made of metal or any other suitable material. Cable guide 84 may be made from molded plastic, or any other suitable material. Drawer slide 70 is preferably made of metal, such as steel, with the exception of the ball bearing cages 166 for the ball bearings, which may be made of plastic. Spring 82 of interlock 72 may exert a force of approximately 1.5 pounds. Other spring strengths may, of course, be used. Cable 74 may be a steel cable composed of seven strands, with each strand made of seven individual filaments. Cable 74 may have a tensile strength of 40 pounds. Cable 74 may preferably be made of stainless steel and include a vinyl coating. The diameter of cable 74 after coating may be 0.024 inches, although other dimensions can be used. To avoid kinking of cable 74, surfaces that come in contact with cable 74, such as engagement lug 104, may be curved with a radius of at least 0.125 inches to help reduce the possibility of kinking. As several possible alternatives to steel, cable 74 could be a string, a plastic based line, such as those used as fishing lines, or any other elongated, flexible member with suitable tensile strength.

A single interlock 72 is all that is needed for each drawer in the cabinet. The opposite drawer slide can thus be a regular drawer slide with no interlock attached. Interlock 72, of course, can be attached directly to the cabinet, rather than integrated with the drawer slide. During the installation of the interlock system into a cabinet, the slack in the cable may be easily set by securing one end of the cable, opening a single drawer, and then pulling the cable until substantially all of its slack is removed. The cable is then secured in that condition. When the drawer is thereafter closed, the cable will have sufficient slack to allow only a single drawer to be opened at a time. Alternatively, cables 74 could be manufactured at a preset length to fit different cabinet heights. The installer of the interlocks therefore could simply fasten the cable in the desired location and the length of the cable will create the appropriate slack to allow a single drawer to be opened. Once the appropriate length of a cable is determined for a given cabinet height, cables could be easily mass-produced by a manufacturer by simply cutting them to the appropriate lengths.

While the present invention has been described in terms of the preferred embodiments depicted in the drawings and discussed in the above specification, it will be understood by one skilled in the art that the present invention is not limited to these particular preferred embodiments, but includes any and all such modifications that are within the spirit and scope of the present invention as defined in the following claims.

What is claimed is:

1. An interlock for a drawer positionable within a cabinet, said drawer being movable in the cabinet in a first direction toward an open position and in a second, opposite direction toward a closed position, said interlock comprising:

an elongated, flexible member;

a slack take-up mechanism engageable with said elongated, flexible member and movable between a higher slack position and a lower slack position, said higher slack position allowing said elongated, flexible member to exist in a higher slack condition, said lower slack position causing said elongated, flexible member to exist in a lower slack condition;

a cam operatively coupled to said slack take-up mechanism and to said drawer, said cam adapted to switch the slack take-up mechanism from the higher slack position to the lower slack position when the drawer is moved in the first direction; and a biasing member adapted to exert a force against said take-up mechanism that urges said slack take-up mechanism toward said lower slack position.

2. The interlock of claim 1 wherein said biasing member is a spring.

3. The interlock of claim 2 wherein said force of said biasing member has a magnitude that is independent of the magnitude of a force exerted on the drawer in said first direction.

4. The interlock of claim 3 wherein said slack take-up mechanism includes a slide movable in a linear direction generally parallel to said first direction, said slide including an engagement surface positioned to engage said cable.

5. The interlock of claim 2 further including a stop that prevents said cam from switching said slack take-up mechanism from the higher slack position to the lower slack position when the elongated, flexible member is in said lower slack condition.

6. The interlock of claim 5 wherein said cam is adapted to prevent said drawer from being moved to said open position when said cam engages said stop.

7. The interlock of claim 4 wherein said stop is an embossment.

8. The interlock of claim 1 wherein said elongated, flexible member is a cable.

9. The interlock of claim 8 further including a cable guide attached adapted to snap-fittingly receive the cable from at least one direction.

10. The interlock of claim 9 wherein said cable is in communication with at least one other drawer interlock associated with another drawer, said at least one other drawer interlock adapted to change said cable to said lower slack condition when the another drawer is moved to an open position.

11. The interlock of claim 8 wherein said cable is in communication with a lock, said lock adapted to selectively change said cable between said lower and higher slack conditions.

12. The interlock of claim 11 wherein said cable is in communication with at least one other drawer interlock associated with another drawer, said at least one other drawer interlock adapted to change said cable to said lower slack condition when the another drawer is moved to an open position.

13. The interlock of claim 8 further including a second cable in communication with a lock, said lock adapted to selectively change said second cable between lower and higher slack conditions, said drawer being prevented from being moved to the open position when said second cable is in said lower slack condition, said second cable being in operative engagement with said slack take-up mechanism.

14. A cabinet having at least one drawer movable within the cabinet in a first direction toward an open position and in a second, opposite direction toward a closed position, said cabinet comprising:

a frame adapted to support said drawer when positioned within the cabinet;

an elongated, flexible member positioned within said cabinet, said elongated, flexible member changeable between a lower slack condition and a higher slack condition;

an interlock positioned within said frame and in operative engagement with said elongated, flexible member, said interlock adapted to prevent said drawer from moving to said open position when said elongated, flexible member is in said lower slack condition and to allow said drawer to move to said open position when said elongated, flexible member is in said higher slack condition; and a slack take-up mechanism attached to said interlock and adapted to change said elongated, flexible member from said higher slack condition to said lower slack condition when the drawer is moved from the closed position to the open position, said slack take-up mechanism adapted to exert a force on said elongated, flexible member that has a magnitude which is independent of a force applied in said first direction to the drawer when said drawer is substantially closed.

15. The cabinet of claim 14 wherein said elongated, flexible member is a cable.

16. The cabinet of claim 15 wherein said cable is in communication with at least one other drawer interlock associated with another drawer, said at least one other drawer interlock adapted to change said cable to said lower slack condition when the another drawer is moved to the open position.

17. The cabinet of claim 15 wherein said slack take-up mechanism includes a slide movable in a linear direction generally parallel to said first direction, said slide including an engagement surface positioned to engage said cable.

18. The cabinet of claim 15 wherein said slack take-up mechanism includes a biasing member adapted to exert a force against said cable that urges said cable toward said lower slack position whenever the drawer associated with said interlock is moved to the open position.

19. The cabinet of claim 18 wherein said biasing member is a spring.

20. The cabinet of claim 14 wherein said elongated, flexible member is in communication with a lock, said lock adapted to selectively change said elongated, flexible member between said lower and higher slack conditions.

21. The cabinet of claim 14 further including at least one drawer slide attached to said drawer, said drawer slide movable between an extended position corresponding to the attached drawer's open position and a retracted position corresponding to the attached drawer's closed position, said interlock mounted on said drawer slide and adapted to prevent said drawer slide from moving to said extended position when said elongated, flexible member is in said lower slack condition and to allow said drawer slide to move to said extended position when said elongated, flexible member is in said higher slack condition.

* * * * *

UNITED STATES PATENT AND TRADEMARK OFFICE

CERTIFICATE OF CORRECTION

PATENT NO. : 6,779,855 B2
DATED : August 24, 2004
INVENTOR(S) : Keith A. Hoffman It is certified that error appears in the above-identified patent and that said Letters Patent is hereby corrected as shown below:

Column 1,
Line 47, “reconfirmation” should be -- reconfiguration --

Column 5,
Lines 38 and 39, “reconfirmation” should be -- reconfiguration --

Column 14,
Line 47, “claim 4” should be -- claim 5 --

Signed and Sealed this

Eighteenth Day of January, 2005

JON W. DUDAS
*Director of the United States Patent and Trademark Office*